United States Patent [19]

Falomo

[11] 4,019,667

[45] Apr. 26, 1977

[54] MACHINE FOR CONVEYING A MATERIAL IN WEB FORM THROUGH TREATMENT TUBS

[76] Inventor: Lodovico Falomo, Strada Statale Pontebbana Orcenigo Inf., Zoppola (Pordenone), Italy

[22] Filed: Jan. 17, 1975

[21] Appl. No.: 542,044

[30] Foreign Application Priority Data

Jan. 24, 1974 Italy ..... 19772/74

[52] U.S. Cl. ..... 226/171; 226/189; 354/321

[51] Int. Cl.[2] ..... B65H 17/34

[58] Field of Search ..... 226/118, 119, 189, 171; 354/319, 320, 321, 322; 198/208

[56] References Cited

UNITED STATES PATENTS

| | | | |
|---|---|---|---|
| 1,955,813 | 4/1934 | Klappenecker | 226/171 UX |
| 2,913,973 | 11/1959 | Bull | 226/189 X |
| 2,927,503 | 3/1960 | Zollinger | 354/321 X |
| 2,965,013 | 12/1960 | Dorion | 226/119 X |
| 3,287,013 | 11/1966 | Fairbanks | 226/171 X |
| 3,413,904 | 12/1968 | Friedel | 354/322 X |
| 3,598,037 | 8/1971 | Houston | 354/319 X |
| 3,753,488 | 8/1973 | Wilson | 198/208 |

*Primary Examiner*—Richard A. Schacher
*Attorney, Agent, or Firm*—Cushman, Darby & Cushman

[57] ABSTRACT

A device is disclosed, for treating a material (for example photographic films) through a plurality of processing baths, different stay times being required in different baths. The desired variations of the stay times are obtained by varying the geometrical configuration of the material strip, this being obtained by causing the travel path of the material to be varied geometrically by increasing or reducing lap bends introduced in the strip of material by lifting or depressing a few conveying rollers.

9 Claims, 4 Drawing Figures

MACHINE FOR CONVEYING A MATERIAL IN WEB FORM THROUGH TREATMENT TUBS

Installations for the treatment of photosensitive materials in film form or in web form are known, and also those for treatment of materials in certain formats, comprising a plurality of tubs containing the treatment baths, where the material is caused to pass by an automatic conveyance apparatus.

In this kind of installations there are a number of problems inherent in the obtention of a satisfactory operation.

The dragging members for the photosensitive material should be such as not to damage, in the slightest, the image-carrying surface: in addition the immersion time of the material in each bath should be capable of being varied.

This variation of the stay time cannot be conveniently obtained by varying the speed of translation of the entraining means: as a matter of fact, a speed adjustment as carried out tub-by-tub involves a considerable constructional intricacy and becomes unpracticable when the material is in strip form, that is, a portion thereof goes through a tub when other portions go through adjoining tubs.

This invention aims at providing an apparatus for conveyance which conveniently permits to vary the time of stay of the photosensitive material in a tub, by varying the length of the travel path of the material through the bath.

In addition, the apparatus according to the invention fulfils the necessary requirement of protecting from any damage the photosensitive surface of the conveyed material.

In an installation for treating the photosensitive material in sheet form, with a plurality of tubs placed in side-by-side relationship and containing the treatment baths, according to the invention, there is arranged within each tub an apparatus for conveying the sheet material, comprising two first rotatable rollers borne in side-by-side relationship on the tub top and, in a lower location, a rotatable roller having its axis parallel to the axes of the former rollers, a flexible web being passed on the first named rollers, from which it is sent to form an innermost bend passed onto the second roller, and an outermost bend on which a heavy drum is freely resting, a pressure cylinder being substantially tangent to the former rollers with insertion in the web, motive means driving to rotation at least one of said first and second rollers.

The inner surface of the web, in correspondence with the innermost bend, is the conveying surface for the sheet material to be treated; obviously, the length of the innermost bend can conveniently be varied by shifting the second roller vertically, so as to move it towards and away with respect to the first rollers. It becomes thus possible to vary the time of stay of the material to be treated within the bath, the latter containing substantially the entire innermost bend of the flexible strip.

In order that the advantages and the constructional features of the invention may be better understood, an exemplary embodiment thereof will now be described as illustrated in the accompanying drawings, wherein.

Figure 1:
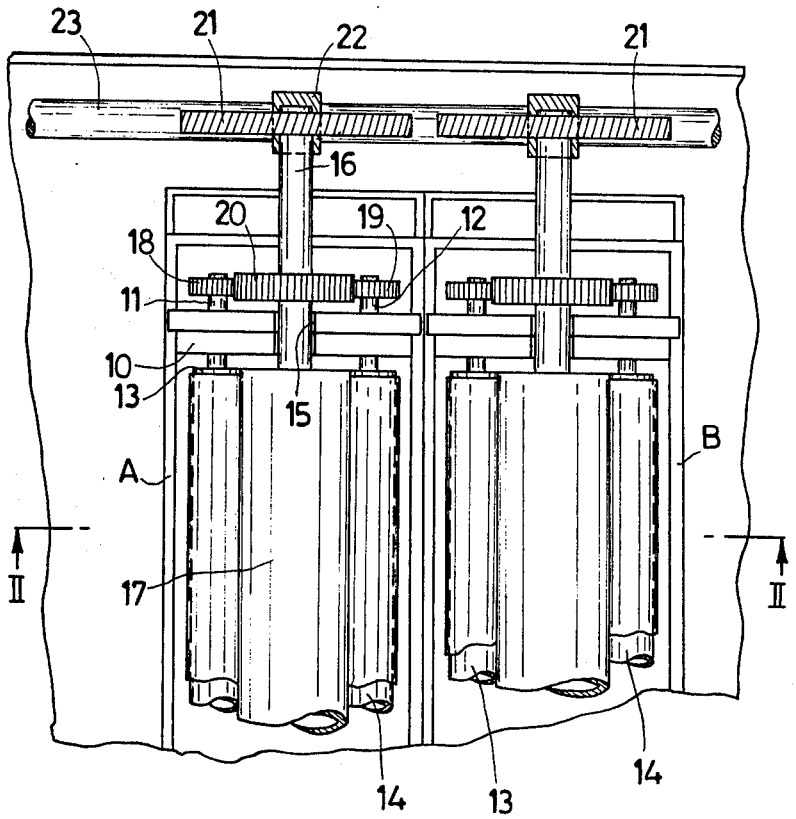
FIG. 1 shows a plan view of a portion of the treatment installation incorporating a conveying machine according to this invention.
Figure 2:
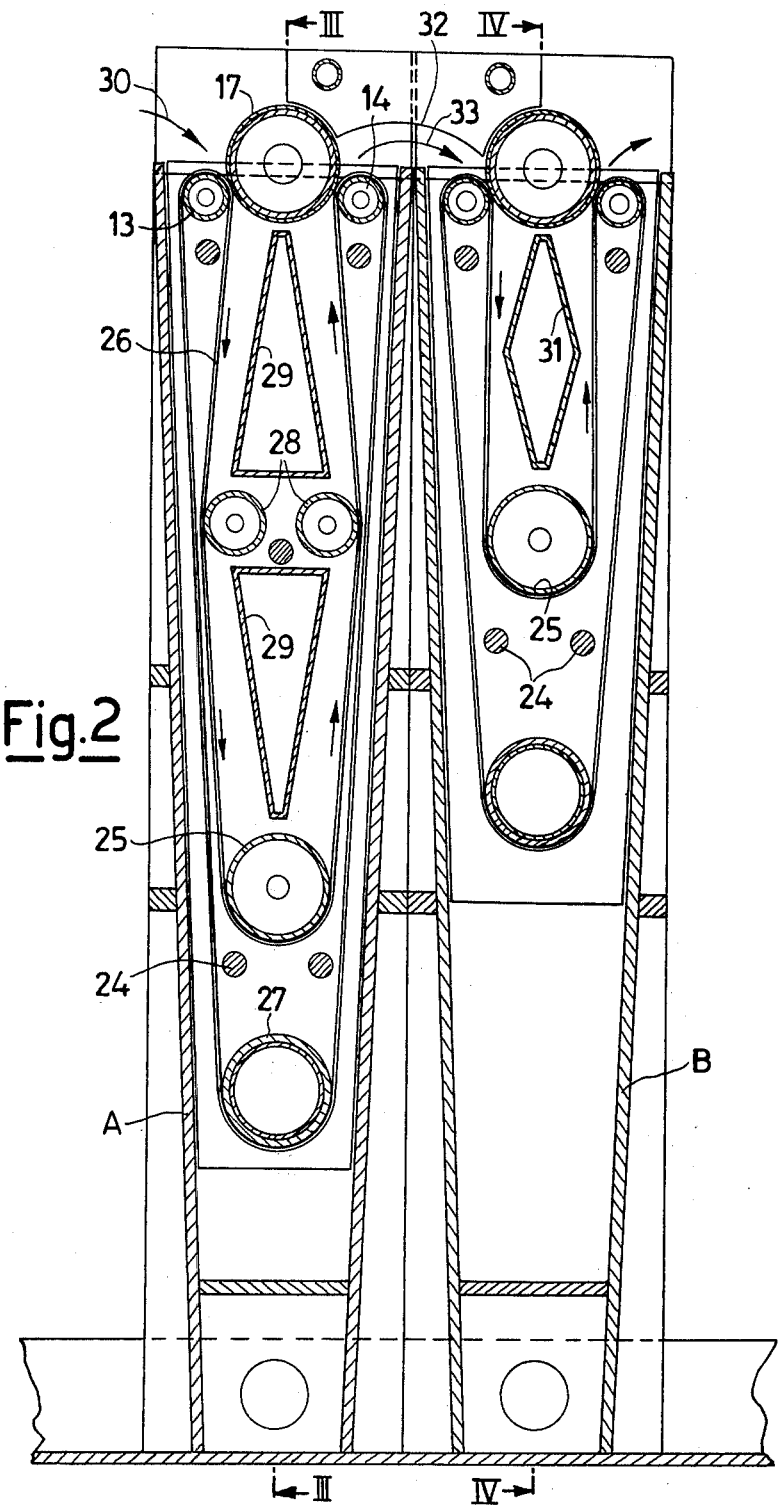
FIG. 2 shows a cross-sectional view taken along the line II—II of FIG. 1.
Figure 3:
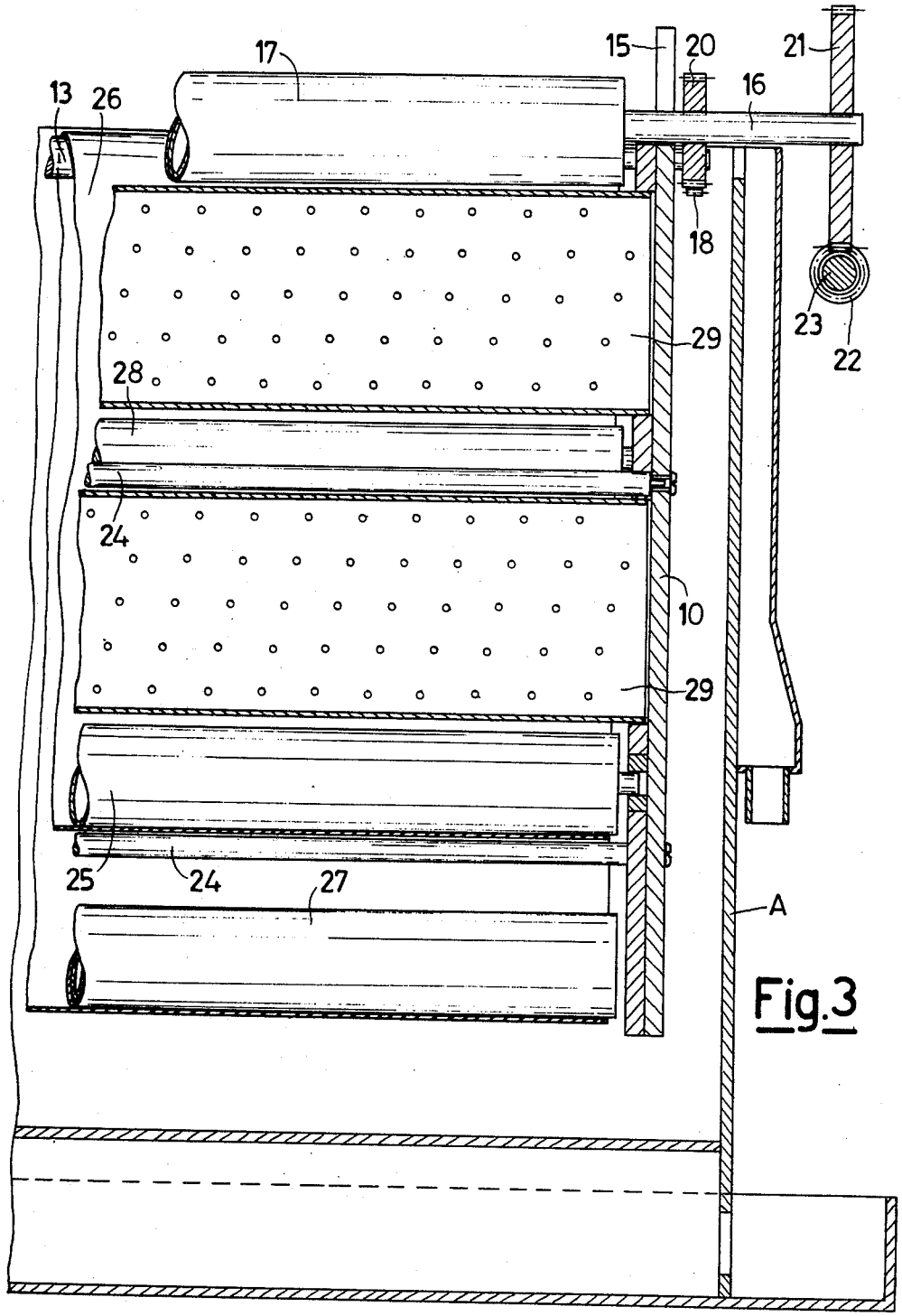
FIGS. 3 and 4 show cross-sectional views taken along the lines III—III and IV—IV of FIG. 2, respectively.
Figure 4:
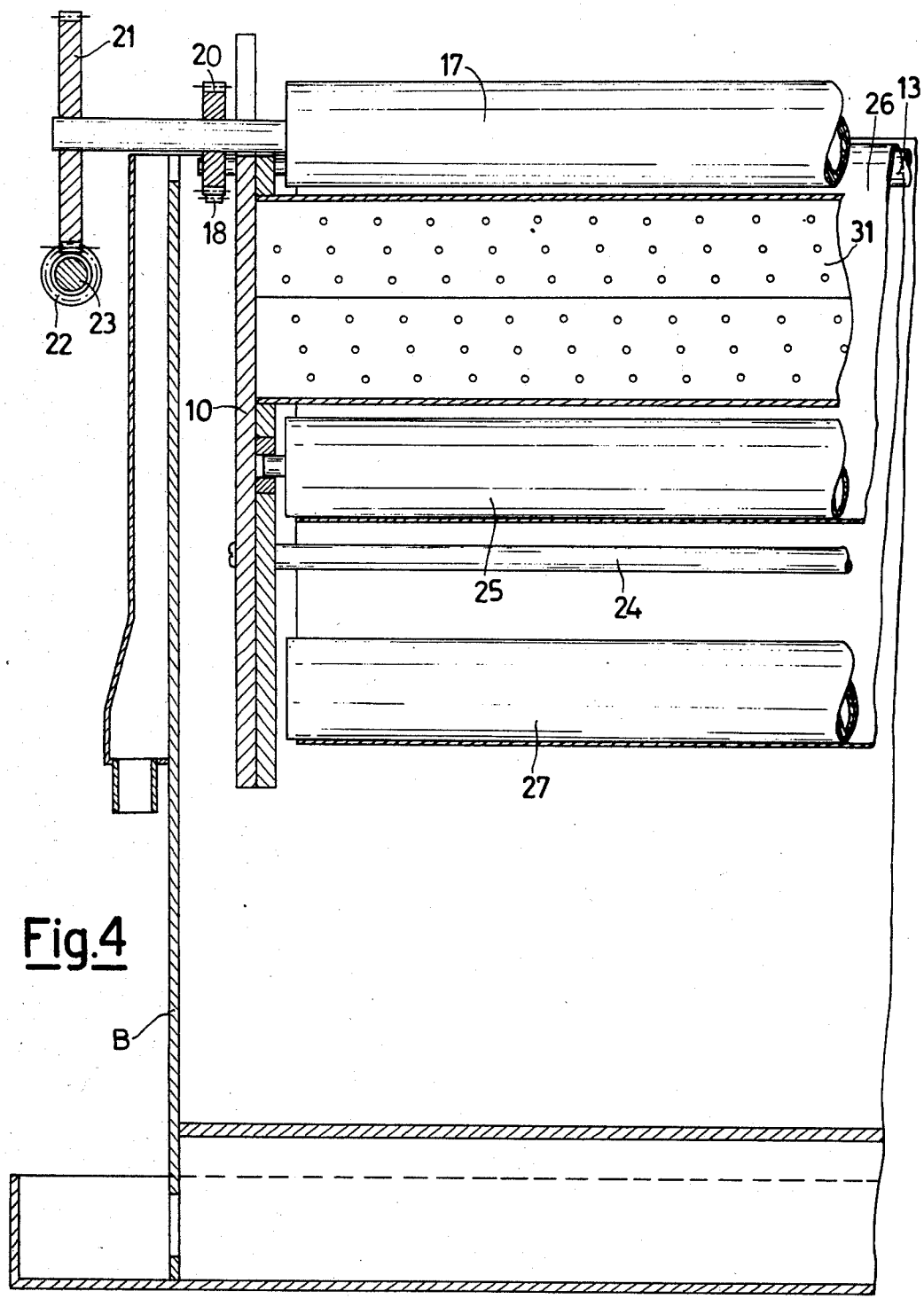

The drawings show two tubs, A and B, of a treatment installation, which could comprise a set of any number of serially arranged tubs.

In the tub A there is mounted a conveying machine as borne by a framing, the latter comprising two sidewalls 10 as connected by spreaders 24.

On the sidewalls 10 there are journalled the shafts 11 and 12 of the rollers 13 and 14. The shaft 16 of the roller 17 is housed in slits 15, on the bottom edge of which it is free to rotate.

The shafts 11 and 12 carry at their ends gears 18 and 19 which are in mesh with the gear 20 as keyed to the shaft 16. The ratio of the diameters of these gears is equal to the ratio of the rollers as borne by their respective shafts. Lastly, the shaft 16 is extended so as to bear a gear 21 meshing with the gear 22 of a shaft 23, the latter being conventionally connected to a prime mover (not shown).

On the sidewalls 10 there is also pivoted an idle roller 25.

A closed loop web, as shown at 26, passes over the rollers 13 and 14, forming a first innermost bend which is wrapped around the roller 25, and a second outermost bend in which there is freely housed a tubular member 27, having an appropriate weight, which provides to keep the web 26 taut.

The innermost bend is additionally guided by rollers 28 which are also pivoted in an idly rotatable manner to the sidewalls 10.

The tub A is intended to be filled with the treatment liquor until substantially sweeping the roller 17.

The operation of the apparatus as shown is such that the shaft 23 is rotated in such a direction that the roller 17 is driven to rotation in the anticlockwise direction. The mechanical connections as shown will cause the rollers 13 and 14 to be rotated in the clockwise direction, the rollers having a surface speed equal to that of the roller 17.

A sheet of the material to be treated, which is introduced between the rollers 13 and 17, as shown by the arrow 30, rests on the web 26, aided also by the baffles 29. The material is passed under the rollers 28 and then about the roller 25, to rise again on the right side of the innermost bend of the web, to emerge between the rollers 17 and 14.

It should be noted that the material to be treated is in direct contact with the rollers 28 and 25, whose surface speed is equal to web sliding speed; by so doing, slippages are prevented which would damage the surfaces of the material being treated. It is noted that by merely varying the level of the roller 25 in the tub, the length of the path of the sheet material is also varied, the strip 26 being continuously kept taut by the ballast drum 27.

Within comparatively narrow limits of variation of the level of the roller 25, the shape and the arrangement of the guideways 29 and the rollers 28 may be kept unaltered.

When, conversely, the level is considerably varied, these members may take an appropriate configuration of equivalent value. An example of these modifications is shown in the conveyance machine as contained in the tub B. Parts equivalent to corresponding parts as contained by the tub A are indicated by the same reference numerals. In the tub B, provision is made for a shorter path of the material to be processed, and consequently a shorter stay time. In such a case the intermediate rollers 28 are redundant and a single leading guideway 31 is enough, which is wholly akin to the guideways 29.

The pass of the sheet material from one tub to the other along the direction of the arrow 33, is encouraged by a guideway 32.

Any number of tubs may be arranged in parallel, so as to carry out any desired sequence of treatments for the conveyed photosensitive material.

This material can either be cut in formats or in continuous web form.

Obviously the minimum format as allowable lengthwise is defined by the distance between the rollers which act on the conveying web; for example in the example shown it should not be less than the distance between the rollers 17, 18 and 25 in the tub A, or between the rollers 17 and 25 in the tub B. Pressure rollers 28 can additionally be provided to reduce the minimum allowable format.

In the case of a continuous-web material of such a length as to involve maby tubs simultaneously, it can be provided so that subsequent tubs have slightly increasing speeds of the respective conveying web to avoid the formation of bends in the strip, which could bump into fixed component parts and damage the sensitive surface, especially in the connection area between a tub and another.

The web 26 can be of any adequate flexible material, possibly porous of foraminous material to allow a better flow of the liquor in the tubs. It can also be formed by a plurality of parallel belts placed in side-by-side relationship.

The leading guideways 29 and 31 can advantageously be foraminous and liquor drawn from the tub may be recycled therein so as to provide an even flow of liquor and a treatment as far as possible homogeneous for the material conveyed by the web 26. The guideways can anyhow have a various profile or can be replaced by rollers to fulfil their function of guiding the sheet material without wrinkling it.

The constructional details of the installations for the treatment of sensitive materials are not described in detail herein as they are well known to those skilled in the art. Appropriate materials will be selected, for example, for carrying out the construction of the several component parts, especially the coating for drums or rollers which come into contact with the surface of the material being processed.

An appropriate shape will be imparted to the guideways of the kind as diagrammatically shown at 32, which can provide for the use of rollers or a sliding lap on rollers. These guideways, in addition to between adjoining tubs, can be adopted also in correspondence of the starting or the final units of the treatment installation.

What is claimed is:

1. An apparatus for conveying a sheet material within a tub of a treatment installation including a plurality of adjacent tubs in which treatment baths for the sheet material are contained, said apparatus comprising two first parallel rotary rollers placed in laterally spaced relationship at the top of the tub, a second parallel rotary roller located below said first rollers at a selected distance thereform, a flexible endless web passing over each one of said first rollers and below said second roller to form within the tub an innermost U-shaped bend engaged with the first and second rollers and having an inner surface adapted to accompany the sheet material through a U-shaped path within the tub and an outermost U-shaped bend provided with tensioning means, driving means coupled to at least one of said first and second rollers to rotate the coupled roller and to consequently advance the flexible web, a rotary pressure cylinder parallelly resting on the first rollers to maintain the sheet material adherent to the flexible web at the beginning and the end of said U-like path and parallel rotary idler rollers disposed intermediated said first and second rollers and cooperating with the inner surface of the descending and rising portions of the innermost bend of the flexible web to engage and maintain the sheet material adherent to the flexible web at the descending and rising portions of said U-like path.

2. An apparatus according to claim 1, wherein said tensioning means includes a heavy roller resting on the bottom of the outermost bend of the flexible web.

3. An apparatus as in claim 1 wherein the maximum lateral distance between the peripheries of said idler rollers is greater than the maximum lateral distance between said first rollers and is greater than the diameter of said second roller whereby the innermost U-shaped bend is spread laterally.

4. An apparatus according to claim 1, characterized in that in the vicinity of the web where the latter forms the innermost bend guiding baffles are provided for the sheet material being conveyed.

5. An apparatus according to claim 1, characterized in that said web is formed by a non-continuous structure so as to be permeable to the treatment bath liquor.

6. An apparatus according to claim 1, characterized in that said rollers are mounted on a framing which can be slipped into the tub.

7. An apparatus according to claim 1, characterized in that the sliding speed of the web in a tub exceeds the travel speed of the web in the next preceding tub in the plurality of tubs.

8. In apparatus for conveying and treating sheet material, a tub containing a treatment bath, two parallel rotary rollers disposed in laterally spaced-apart relationship at the top of the tub, driving means for at least one of said laterally spaced-apart rollers,, a main idler roll located in said tub below said laterally-spaced apart rollers and parallel thereto, a flexible endless web in said tub arranged to form first and second U-shaped bends, said first U-shaped bend having an inner surface adapted to accompany the sheet material through a U-shaped path and being disposed within the spaced above said second U-shaped bend, said web passing over each of said laterally spaced-apart rollers and under said main idler roll to form said first bend and web passing under and supporting a heavy tensioning cylinder to form said second bend whereby the length of the path of the sheet material may be varied by raising or lowering said main idler roll to vary the length of said first U-shaped bend while said web is continuously maintained taut by said tensioning cylinder, and a rotary pressure cylinder parallel to and resting on said laterally spaced-apart rollers, the axis of rotation of said pressure cylinder being disposed above the axes of said laterally spaced-apart rollers.

9. Apparatus as in claim 8 wherein the driving means includes driving connections between said main idler roller and each of said laterally spaced apart rollers and means connected directly to said main idler roller for driving the same.

* * * * *